US007470921B2

(12) United States Patent
Custer

(10) Patent No.: US 7,470,921 B2
(45) Date of Patent: Dec. 30, 2008

(54) LIGHT-EMITTING DIODE DEVICE

(75) Inventor: Eric J Custer, Albion, IN (US)

(73) Assignee: Summit Business Products, Inc., Columbia City, IN (US)

( * ) Notice: Subject to any disclaimer, the term of this patent is extended or adjusted under 35 U.S.C. 154(b) by 520 days.

(21) Appl. No.: 11/231,227

(22) Filed: Sep. 20, 2005

(65) Prior Publication Data

US 2005/0280683 A1 Dec. 22, 2005

(51) Int. Cl.
*G21G 1/12* (2006.01)

(52) U.S. Cl. ..... 250/504 R; 362/364; 362/227; 362/800; 362/362; 250/492.1

(58) Field of Classification Search ..... 204/478; 362/362, 364, 227, 800; 433/29; 156/331.1; 250/492.1, 453.11, 454.11, 455.11, 504 R, 250/504 H See application file for complete search history.

(56) References Cited

U.S. PATENT DOCUMENTS

| | | | | |
|---|---|---|---|---|
| 4,672,258 | A | 6/1987 | Konishi | |
| 5,216,283 | A * | 6/1993 | Lin | 257/787 |
| 6,102,696 | A * | 8/2000 | Osterwalder et al. | 433/29 |
| 6,170,963 | B1 | 1/2001 | Arnold | 362/249 |
| 6,561,640 | B1 | 5/2003 | Young | 347/102 |
| 6,641,284 | B2 | 11/2003 | Stopa et al. | 362/240 |
| 6,719,558 | B2 | 4/2004 | Cao | 433/29 |
| 6,719,559 | B2 * | 4/2004 | Cao | 433/29 |
| 6,739,716 | B2 | 5/2004 | Richards | 347/102 |
| 6,755,649 | B2 | 6/2004 | Cao | 433/29 |
| 6,783,227 | B2 | 8/2004 | Suzuki et al. | 347/102 |
| 7,214,952 | B2 * | 5/2007 | Klipstein et al. | 250/504 H |
| 2002/0172916 | A1 * | 11/2002 | Cao | 433/29 |
| 2002/0177099 | A1 * | 11/2002 | Cao | 433/29 |
| 2003/0035037 | A1 | 2/2003 | Mills et al. | 347/102 |
| 2004/0135159 | A1 * | 7/2004 | Siegel | 257/88 |
| 2004/0164325 | A1 | 8/2004 | Siegel | 257/200 |
| 2004/0166249 | A1 | 8/2004 | Siegel | 427/558 |
| 2004/0170019 | A1 | 9/2004 | Tamai | 362/102 |
| 2004/0238111 | A1 | 12/2004 | Siegel | 156/102 |

(Continued)

FOREIGN PATENT DOCUMENTS

DE 202 01 493 5/2003

(Continued)

OTHER PUBLICATIONS

Translation of DE 202 01 493.

*Primary Examiner*—Jack I Berman
*Assistant Examiner*—Michael Maskell
(74) *Attorney, Agent, or Firm*—Senninger Powers LLP

(57) ABSTRACT

A UV LED device may be used for curing fluids. In one embodiment, LEDs are positioned on faces defined by an inverted recess in a base portion. The LEDs are configured such that the light beams emitted from the LEDs converge at a single area or point to provide a single, focused area or point of amplified power from the LEDs. In another embodiment, the base portion is elongated to provide a single, focused line or region of amplified power from the LEDs. In another embodiment, the curing process occurs in an inert atmosphere. In one embodiment, a printed circuit is disposed in the base portion to provide power to the LEDs.

26 Claims, 6 Drawing Sheets

U.S. PATENT DOCUMENTS

| | | | | |
|---|---|---|---|---|
| 2005/0068397 | A1 | 3/2005 | Yokoyama | 347/102 |
| 2005/0093952 | A1 | 5/2005 | Hoshinio | 347/102 |
| 2005/0099478 | A1 | 5/2005 | Iwase | 347/102 |
| 2005/0104946 | A1 | 5/2005 | Siegel | 347/102 |
| 2005/0154075 | A1 | 7/2005 | Siegel | 522/8 |
| 2005/0218468 | A1* | 10/2005 | Owen et al. | 257/433 |
| 2005/0231983 | A1* | 10/2005 | Dahm | 362/800 |
| 2006/0275733 | A1* | 12/2006 | Cao | 433/29 |

FOREIGN PATENT DOCUMENTS

| | | | |
|---|---|---|---|
| EP | 1 428 668 | | 6/2004 |
| WO | 2004/011848 | | 2/2004 |
| WO | WO 2004011848 | A2 * | 2/2004 |
| WO | 2005/093858 | | 10/2005 |
| WO | WO 2005093858 | A2 * | 10/2005 |

* cited by examiner

LIGHT-EMITTING DIODE DEVICE

BACKGROUND

1. Field of the Invention

The present invention relates to light-emitting diode devices and, more particularly, to ultraviolet light-emitting diode devices for use in curing fluids.

2. Description of the Prior Art

In methods for ultraviolet (UV) curing of fluids including inks, coatings, and adhesives, the cured substance includes UV photo initiators therein which, when exposed to UV light, convert monomers in the fluids into linking polymers to solidify the monomer material. Conventional methods for UV curing employ UV light-emitting diodes (LEDs) and UV lamps to supply UV light for curing UV curable fluids on various products. However, these methods are often time-consuming and inefficient, thereby increasing difficulty and expense for curing UV curable fluids. For example, known UV LED fluid-curing devices require a large number of light emitting sources which not only add size and cost to a fluid-curing device, but also are inefficient in terms of power usage.

What is needed is an ultraviolet light-emitting diode device which is an improvement over the foregoing.

SUMMARY

The present invention relates to light-emitting diode devices. More particularly, the present invention relates to an ultraviolet (UV) light-emitting diode (LED) device for curing fluids such as inks, coatings, and adhesives, for example. In one embodiment, LEDs are positioned on faces defined by an inverted recess in a base portion. The LEDs are configured such that the light beams emitted from the LEDs converge at a single area or point to provide a single, focused area or point of amplified power from the LEDs. In another embodiment, the base portion is elongated to provide a single, focused line or region of amplified power from the LEDs. In one embodiment, the curing process occurs in an inert atmosphere. Because of the reduced number of light emitting sources required by the present invention, the size and cost of the UV LED device may advantageously be decreased. In one embodiment, a printed circuit is disposed in the base portion to provide power to the LEDs. All of the embodiments of the present invention advantageously reduce the amount of time required for curing the fluid and increase the efficiency of the curing process.

In one form thereof, the present invention provides a device for curing fluids including a base portion; a recess formed in the base portion, the recess defining a plurality of faces, the plurality of faces including a first face and a plurality of second faces substantially surrounding the first face, each second face disposed at an angle with respect to the first face; and at least some of the first and second faces each including at least one light-emitting diode.

In another form thereof, the present invention provides a device for curing fluids including a base portion; a recess formed in the base portion, the recess defining a plurality of faces, the plurality of faces including a first face and a plurality of second faces substantially surrounding the first face, each second face disposed at an angle with respect to the first face, the first face and at least one of the second faces being substantially elongated; and at least some of the first and second faces each including at least one light-emitting diode.

In yet another form thereof, the present invention provides a device for curing fluids including a base portion; a recess formed in the base portion, the recess defining a plurality of faces, the plurality of faces including a first face, a plurality of second faces, and a plurality of third faces, each second face disposed at a first angle with respect to the first face, each third face disposed at a second angle with respect to the first face; and at least some of the first, second, and third faces each including at least one light-emitting diode.

BRIEF DESCRIPTION OF THE DRAWINGS

The above mentioned and other features and objects of this invention, and the manner of attaining them, will become more apparent and the invention itself will be better understood by reference to the following description of exemplary embodiments of the invention taken in conjunction with the accompanying drawings, wherein.

Figure 1:
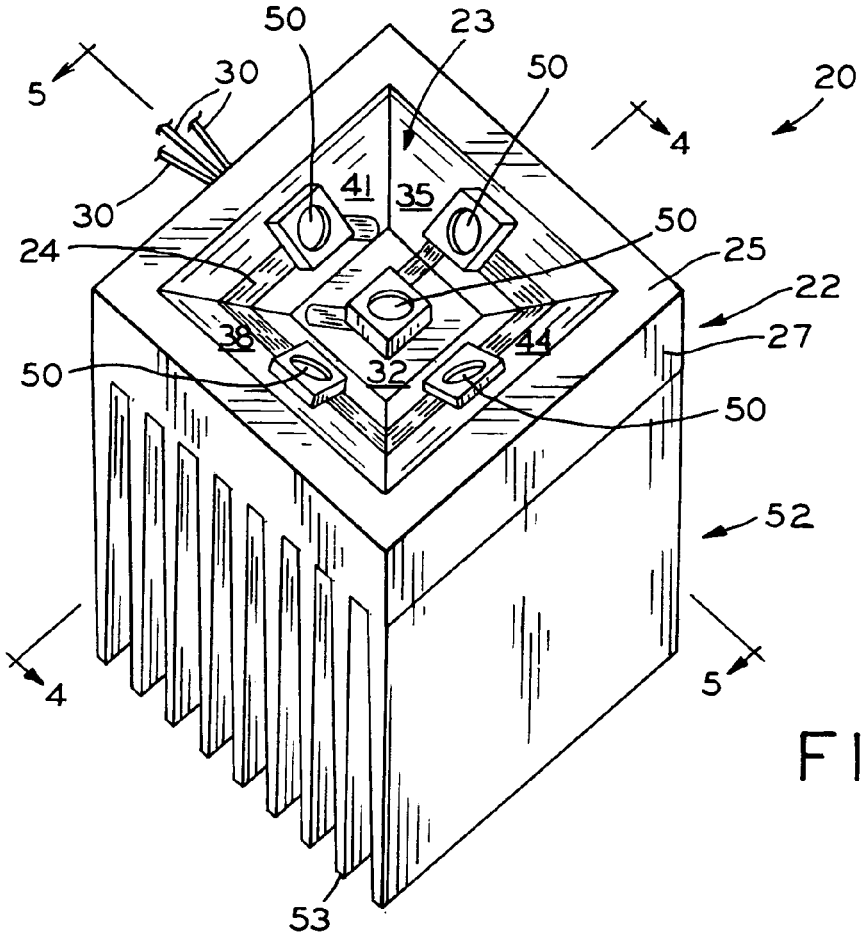
FIG. 1 is a perspective view of an LED device in accordance with the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, and such exemplifications are not to be construed as limiting the scope of the invention in any manner.

DETAILED DESCRIPTION

The present invention generally provides LED devices. More particularly, the present invention relates to a UV LED device for curing fluids. In one embodiment, LEDs are positioned on faces defined by an inverted recess in a base portion. The LEDs are configured such that the light beams emitted from the LEDs converge at a single area or point to provide a single, focused area or point of amplified power from the LEDs. In another embodiment, the base portion is elongated to provide a single, focused line or region of amplified power from the LEDs. In one embodiment, the curing process occurs in an inert atmosphere. Advantageously, all of the embodiments of the present invention reduce the amount of time required for curing the fluids and increase the efficiency of the curing process because of the focused configuration of the plurality of LEDs.

Figure 11:
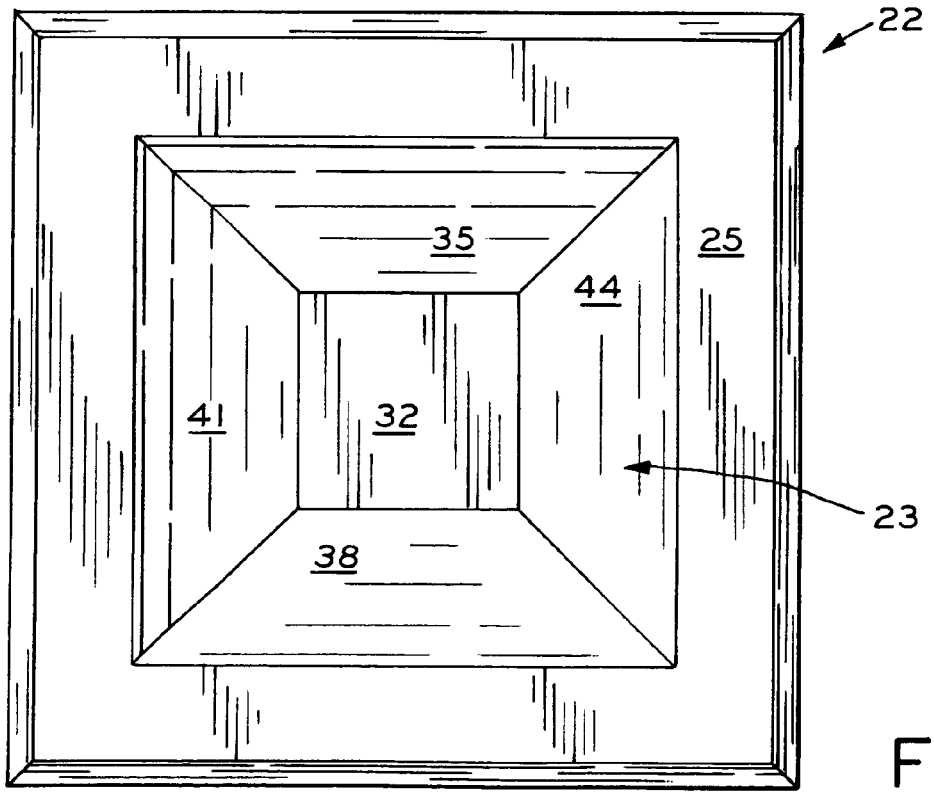
FIG. 11 is a bottom plan view of the device of FIG. 1, further illustrating the orientation of the faces without any apertures or LEDs attached thereto.

Referring to FIGS. 1 and 11, LED device base 22 is shown including bottom edge 25 and recess 23 including faces 32, 35, 38, 41, and 44. First face 32 is formed as a square-shaped face and each second face 35, 38, 41, and 44 is formed as a trapezoid-shaped face. In this way, recess 23 forms an inverted, pyramidal frustum-shaped recess comprised of four congruent trapezoidal-shaped faces 35, 38, 41, 44, and square face 32. Square or first face 32 may be the center face and trapezoidal or second faces 35, 38, 41, and 44 may be the angled faces of LED device 20. Base 22 may be formed of various materials, and, in one embodiment, base 22 is an aluminum block with recess 23 machined therein. Base 22 may be constructed of any heat-dissipating and thermally-conductive material, for example, aluminum, copper, brass, a thermally conductive polymer, cobalt, or a combination of any of the previous, e.g., aluminum combined with a thermally conductive polymer. Recess 23 may be formed through extrusion, milling, or injection-molding processes. Although edge 25 is defined as bottom edge 25, it is to be understood that the bottom side of LED device 20 is the side normally facing a substance to be cured. The bottom side of LED device 20 may be oriented in any configuration including facing sideways, upwards, or any angle therebetween depending on the orientation of the substrate upon which a curable substance is deposited.

Figure 10:
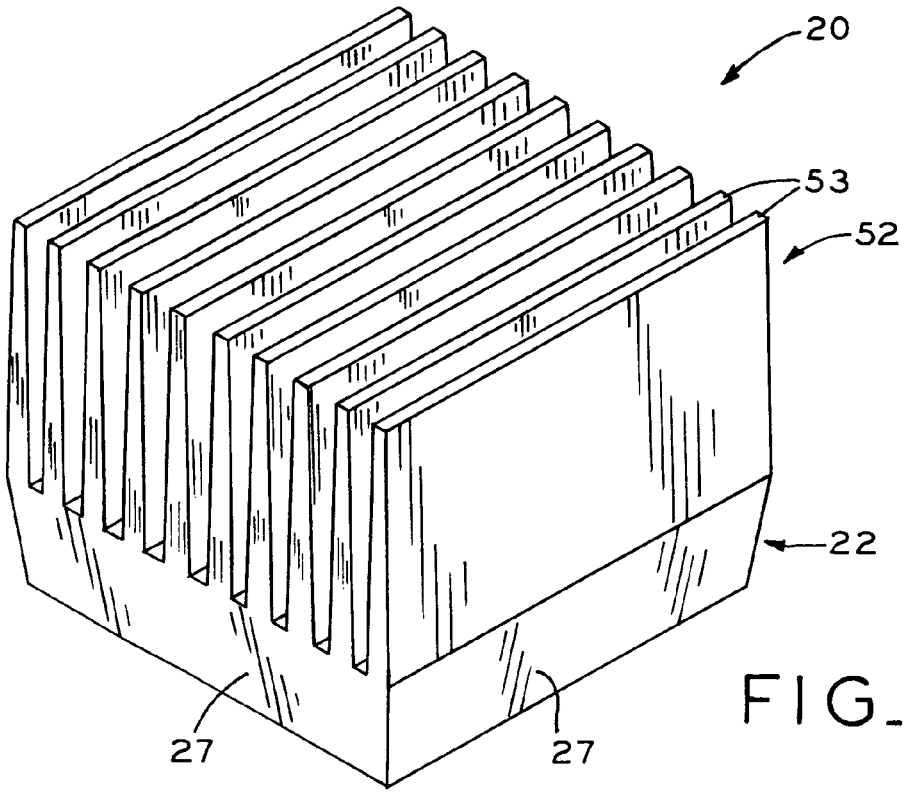
FIG. 10 is a perspective view of the top of the device of FIG. 1.

Referring now to FIGS. 1 and 10, base 22 may be integrally formed with heat sink 52 having heat sink fins 53 extending away from base 22. Thus, heat sink 52 and heat sink fins 53 are made of identical or substantially similar material as base 22.

Figure 2:
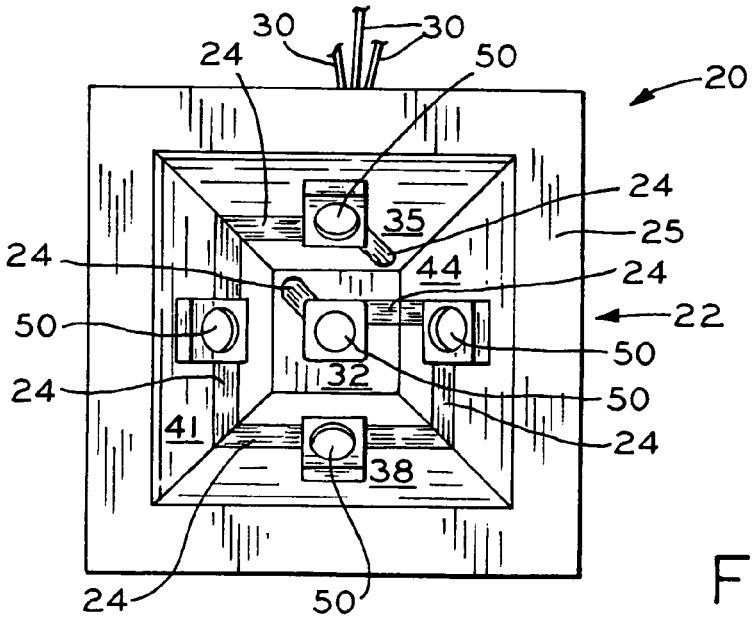
FIG. 2 is a bottom plan view of the device of FIG. 1.
Figure 3:
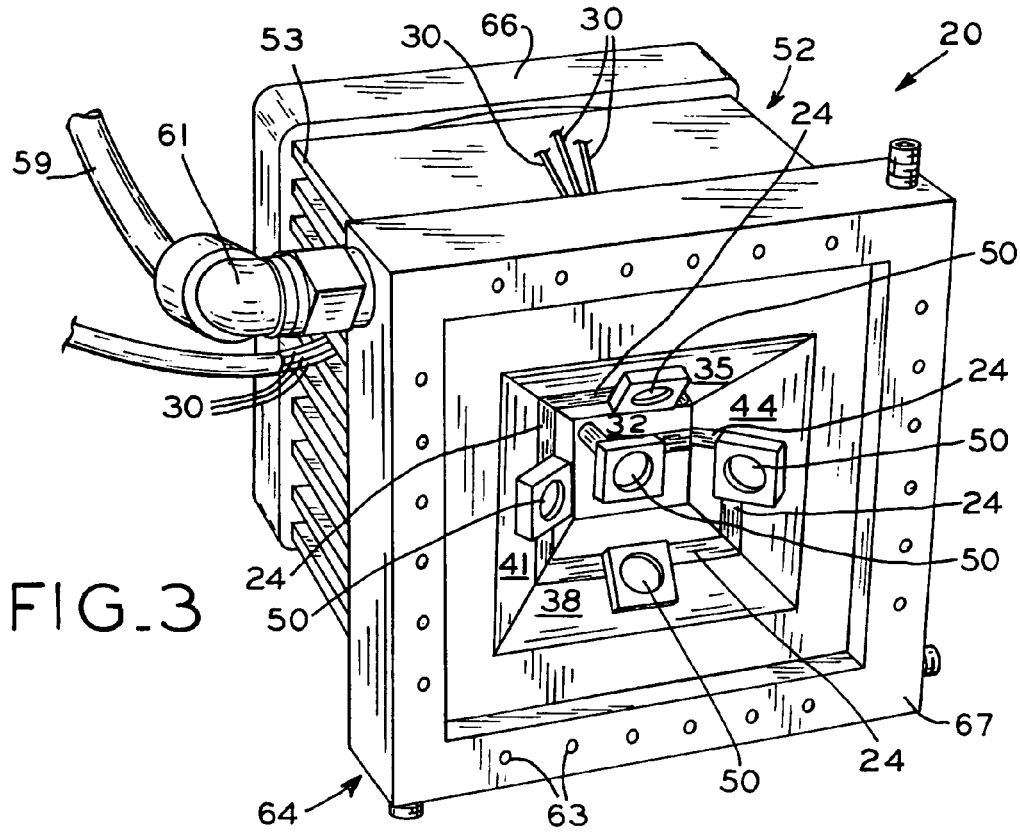
FIG. 3 is a perspective view of the LED device of FIG. 1, further illustrating a structure for supplying an inert atmosphere near the bottom of the LED device.
Figure 6:
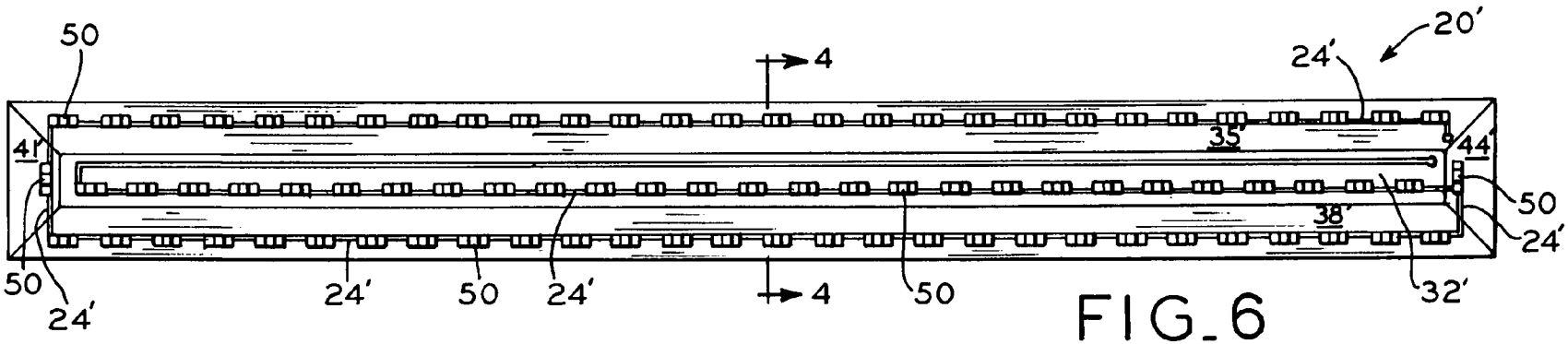
FIG. 6 is a bottom plan view of an alternative embodiment device in accordance with the present invention.

Referring now to FIGS. 1-3, LED device 20 includes base 22 with each face 32, 35, 38, 41, and 44 having LED 50 attached thereto. In one embodiment, LEDs 50 are centered on each respective face of base 22. In another embodiment, only some of faces 32, 35, 38, 41, and 44 have an LED 50 attached thereto. LEDs 50 are shown as relatively large, single point light sources, however, LEDs 50 may also be constructed of a plurality of point light sources (FIG. 6). Printed circuit 24 connects all five LEDs 50 and is connected to wires 30 which extend from base 22 to a power source (not shown) to provide power to LEDs 50. As shown in FIG. 3, wires 30 may be routed between heat sink fins 53 and then away from device 20 to connect to the power source. Printed circuit 24 may be formed directly in the material comprising base 22. In one embodiment, LEDs 50 may be UV LEDs to provide UV light for curing UV curable substances. UV LEDs 50 may be used to cure substances which include UV photo initiators contained therein which, when exposed to UV light, convert monomers in the substance into linking polymers to solidify the monomer material. In an alternative embodiment, LEDs 50 may include other types of LEDs such as visible light LEDs. In one exemplary embodiment, each LED 50 is a Part No. NCCU001 light-emitting diode, available from Nichia Corporation located in Japan.

As shown in FIG. 3, structure 64 may be used to provide an inert atmosphere in which to cure the fluids. The inert atmosphere advantageously removes oxygen from the curing area. During the curing process, the photo initiators in the curable fluid will take an oxygen atom from other chemicals in the fluid in order to solidify the monomer material. If the curing process takes place in an atmosphere which contains oxygen, the curing process is slowed because the photo initiators take oxygen atoms from the surrounding atmosphere instead of the fluid chemicals. If oxygen is removed from the curing area, the photo initiators must latch on to oxygen atoms in the fluids instead of oxygen atoms from the surrounding area, thereby increasing the speed of the curing process. Structure 64 includes a plurality of apertures 63 disposed on bottom surface 67 thereof. Nitrogen or another inert gas may be supplied to hose 59 and enter structure 64 via hose connection 61. The gas circulates throughout the hollow interior of structure 64 and exits via apertures 63 to essentially provide a curtain of inert gas. The curing process will then take place inside this curtained inert atmosphere.

In one embodiment, the inert gas may be provided via a nitrogen source (not shown) connected to hose 59 to supply nitrogen gas to structure 64. The nitrogen source may be a nitrogen tank or a nitrogen generator which essentially removes nitrogen from ambient air and pumps nitrogen gas into hose 59 for delivery to structure 64.

Figure 5:
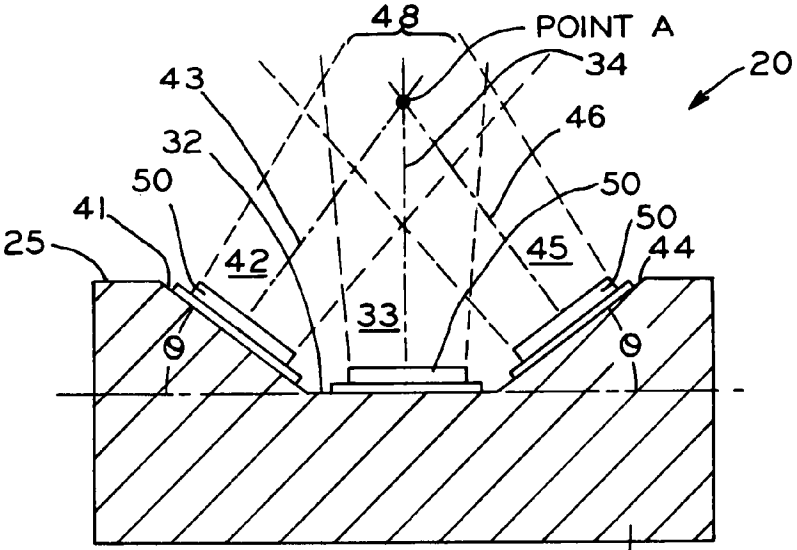
FIG. 5 is a cross-sectional view of the device of FIG. 1 taken along line 5-5 of FIG. 1, which is perpendicular to line 4-4.
Figure 4:
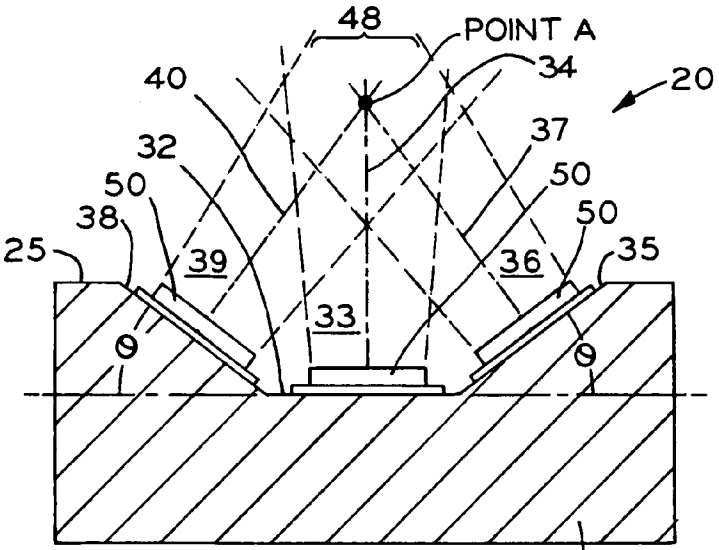
FIG. 4 is a cross-sectional view of the device of FIG. 1 taken along line 4-4 of FIG. 1.

Referring now to FIGS. 4 and 5, in one embodiment, faces 35 and 38 (FIG. 4) and faces 41 and 44 (FIG. 5) are angled such that light emitted from LED 50 on each respective face of base 22 converges at the same area or point, i.e., amplified area 48 or Point A. Faces 35, 38, 41, and 44 are all identically disposed at an angle θ with respect to a plane containing face 32. In one embodiment, angle θ is between 35° and 45°. In an alternative embodiment, angle θ is 36.7°. Various other measurements for angle θ may be chosen depending on the distance from device 20 to the substance to be cured. Additionally, the measurement of angle θ may vary depending on the dimensions of base 22, for example, if base 22 is widened, the measurements for angle θ would necessarily change to sustain the focused area or point of amplified power supplied by LEDs 50. Thus, angle θ could possibly measure anywhere between 0° and 90°.

As shown in FIG. 4, LED 50 on face 38 emits light beam 39, LED 50 on face 32 emits light beam 33, and LED 50 on face 35 emits light beam 36. Light beam 36, light beam 33, and light beam 39 intersect one another and produce amplified area 48 of focused and amplified light wherein light from all three beams 33, 36, and 39 converge. Amplified area 48 may be a single point of amplified and focused light or amplified area 48 may be a small localized area which is positioned on a surface of substrate 68 (FIG. 12) upon which ink or another UV-curable fluid is deposited. As shown in FIG. 5, LED 50 on face 41 emits light beam 42 and LED 50 on face 44 emits light beam 45 which intersect and converge with light beams 33, 36, and 39 to further add amplification and power to amplified area 48. Therefore, light emitted from all five LEDs 50 disposed on faces 32, 35, 38, 41, and 44 converge at amplified area 48 to provide a single, focused, and amplified area of power from LEDs 50, thereby advantageously providing a significantly increased power source at a single area or location.

As shown in FIGS. 4 and 5, each light beam emitted from LEDs 50 is in the general shape of a cone. The most intense light emitted from each LED 50 travels along a beam center line located in the exact center of the light cone, i.e., beam center lines 34, 37, 40, 43, and 46 for light beams 33, 36, 39, 42, and 45, respectively. The intensity of the light decreases moving away from the center of the beam towards the edge of the cone. As such, each beam center line meets at Point A which is the most focused and intense point of amplified light emitted from LEDs 50. The focused power from LEDs 50 may be arranged to provide a focused curing of a substance by positioning area 48 or Point A on the surface of a substrate containing a UV curable fluid. The focused area or point of amplified light reduces the likelihood of incomplete curing and increases the efficiency of the curing process because fewer LEDs need be employed. In one embodiment, Point A may be within amplified area 48.

Figure 7:
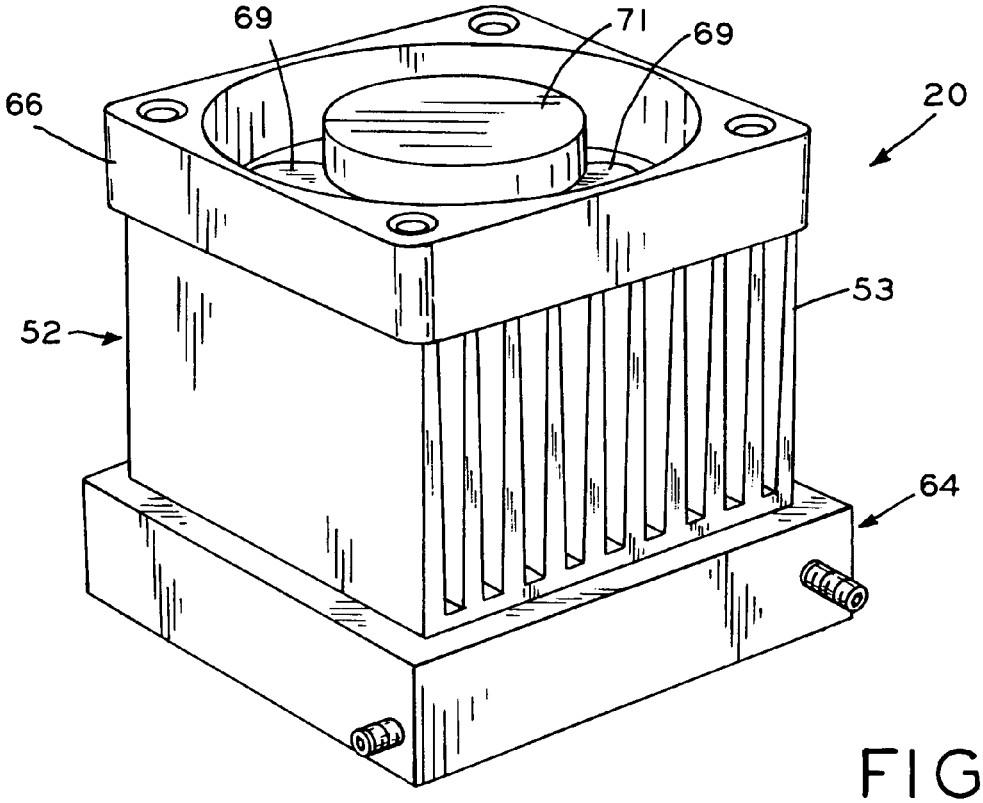
FIG. 7 is a perspective view of the device of FIG. 3.

Referring now to FIG. 7, device 20 is shown including heat sink 52 having heat sink fins 53 and structure 64 attached on a bottom side thereof. Axial fan 66 may be mounted on top of heat sink fins 53 to further facilitate removal of heat from base 22 generated by LEDs 50. Axial fan 66 may include motor 71 to drive blades 69.

Figure 12:
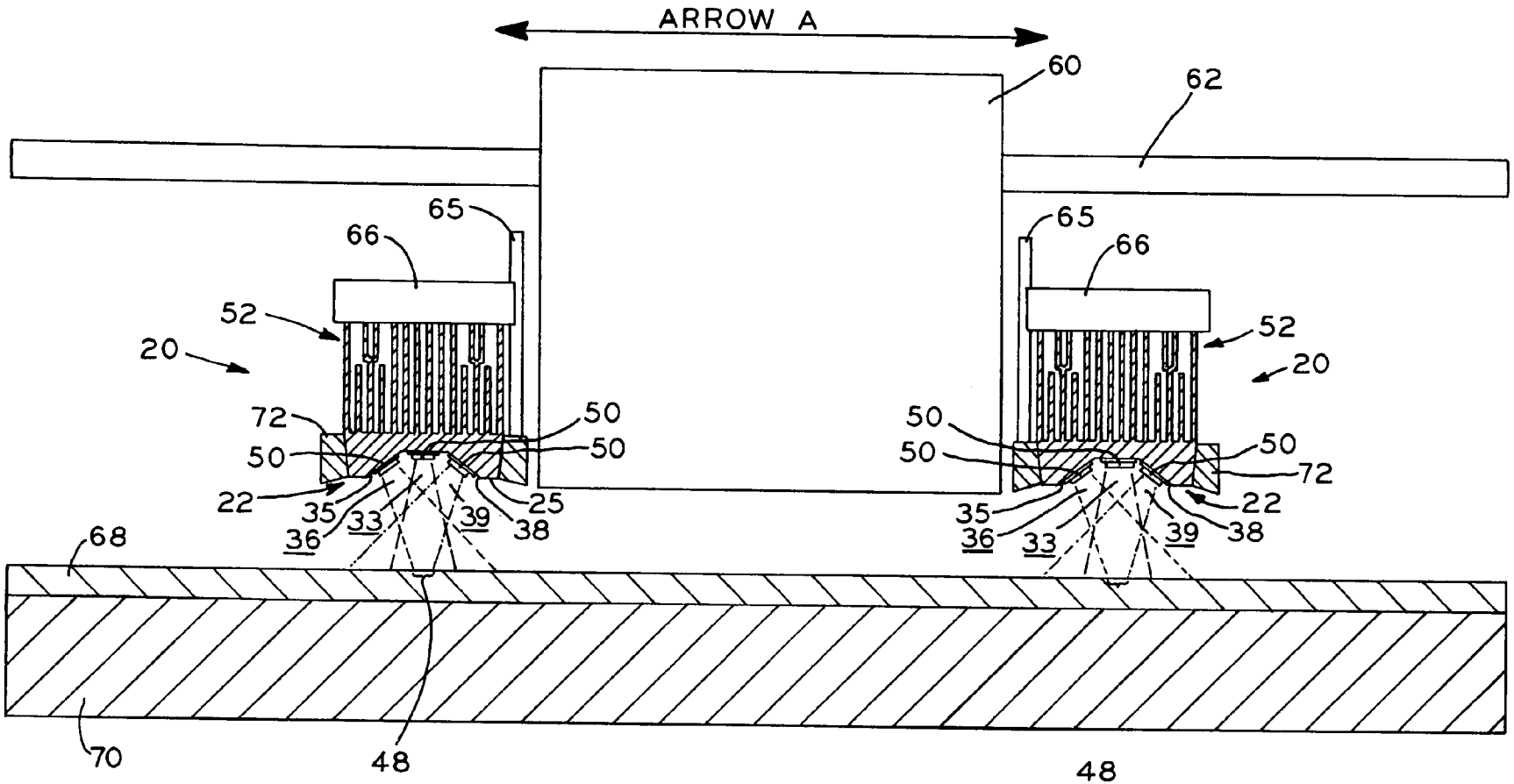
FIG. 12 is a plan view of a portion of a printer with the device of FIG. 1, further illustrating two devices disposed on opposite sides of a printing head.

Referring now to FIG. 12, a typical inkjet printer is shown including print head 60 which is capable of depositing fluid onto substrate 68. Print head 60 laterally moves along rail 62 in the directions defined by double-ended Arrow A. Device 20 is mounted on each side of print head 60 with heat sink 52 extending towards and connected to axial fan 66. Housings or structures 72 may also be provided to surround bases 22 of devices 20 and may be similar to structure 64 (FIGS. 3 and 7) described above. Tubes 65 may provide an inert gas, e.g., nitrogen, to housings 72, similar to hose 59 (FIG. 3) described above. The nitrogen gas in housings 72 may be used to create an inert gas curtain in which to cure the fluid deposited on substrate 68. For example, in one embodiment, the nitrogen gas may be released toward substrate 68 via a plurality of apertures 63 in the bottoms of housings 72 near substrate 68, similar to apertures 63 in structure 64 (FIG. 3) described above. Substrate 68 is supported by support structure 70 which may include a conveyor belt or other moving means capable of supporting and moving substrate 68.

In operation and as shown in FIG. 12, LED 50 on face 35 of base 22 emits light beam 36 towards substrate 68, LED 50 on face 32 emits light beam 33 towards substrate 68, and LED 50 on face 38 emits light beam 39 towards substrate 68. Light beam 36, light beam 33, and light beam 39 intersect one another and produce amplified area 48 of light on substrate 68 wherein light from all three beams 33, 36, and 39 converge. In an exemplary embodiment, amplified area 48 is positioned on a surface of substrate 68 upon which fluid is deposited by print head 60. As shown in FIG. 5 but not shown in FIG. 12, LED 50 on face 41 and LED 50 on face 44 also produce light beams 42 and 45, respectively, which converge with beams 33, 36, and 39 to add to amplified area 48 of focused and amplified light power.

Referring now to FIG. 6, an alternative embodiment LED device 20' is shown including faces 32', 35', 38', 41', and 44'. In one embodiment, each second or angled face 35', 38', 41', and 44' may include a substantially identical angled configuration with respect to a plane containing first or center face 32' as described above for faces 35, 38, 41, and 44 with respect to a plane containing face 32 (FIGS. 4 and 5). Faces 41' and 44' may, in one embodiment, be substantially similar in size and shape to faces 41 and 44, as described above, e.g., the parallel sides of faces 41' and 44' are substantially the same length as the parallel sides of faces 41 and 44. Faces 35' and 38', however, are not substantially congruent to faces 41' and 44'. Instead, faces 35' and 38' are extended along a length of device 20' and their parallel sides are of greater length than the corresponding parallel sides of faces 35 and 38. Faces 35' and 38' have a plurality of LEDs 50 positioned thereon in a straight line arrangement. Similarly, face 32' is extended along the length of device 20' and may be shaped as a rectangle with a plurality of LEDs 50 positioned thereon in a straight line arrangement. Faces 41' and 44' each also include LED 50 mounted thereon. Printed circuit 24' connects all LEDs 50 mounted on device 20' to a power source (not shown).

Light emitted from LEDs 50 on faces 32', 35', 38', 41', and 44' is directed in the same general direction as light emitted from LEDs 50 on faces 32, 35, 38, 41, and 44, as described above (FIGS. 4 and 5). The light emitted from LEDs 50 on faces 35' and 38' is substantially similar to light emitted from faces 35 and 38, as shown in FIG. 4. The primary difference as compared to device 20 is that device 20' has the ability to provide a line or extended region of focused and amplified power centered over face 32' as opposed to a single point or area of focused and amplified power as provided by device 20. In an alternative embodiment, only some of faces 32', 35', 38', 41', and 44' have an LED 50 attached thereto.

Figure 8:
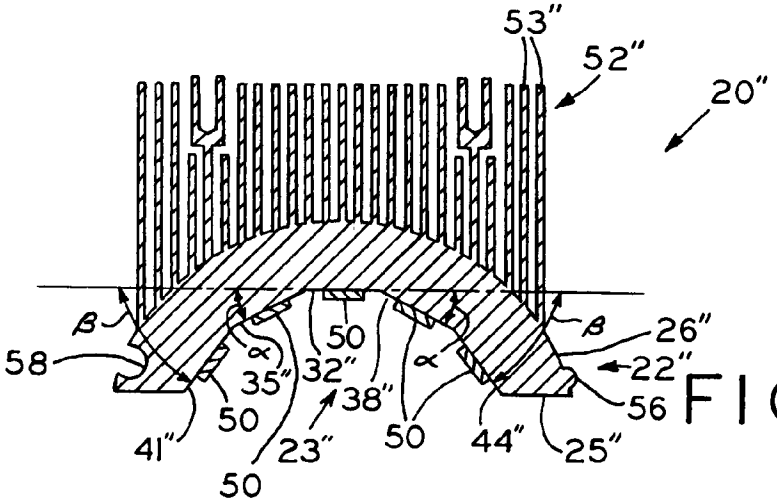
FIG. 8 is a cross-sectional view of the device of FIG. 9 taken along line 8-8.
Figure 9:
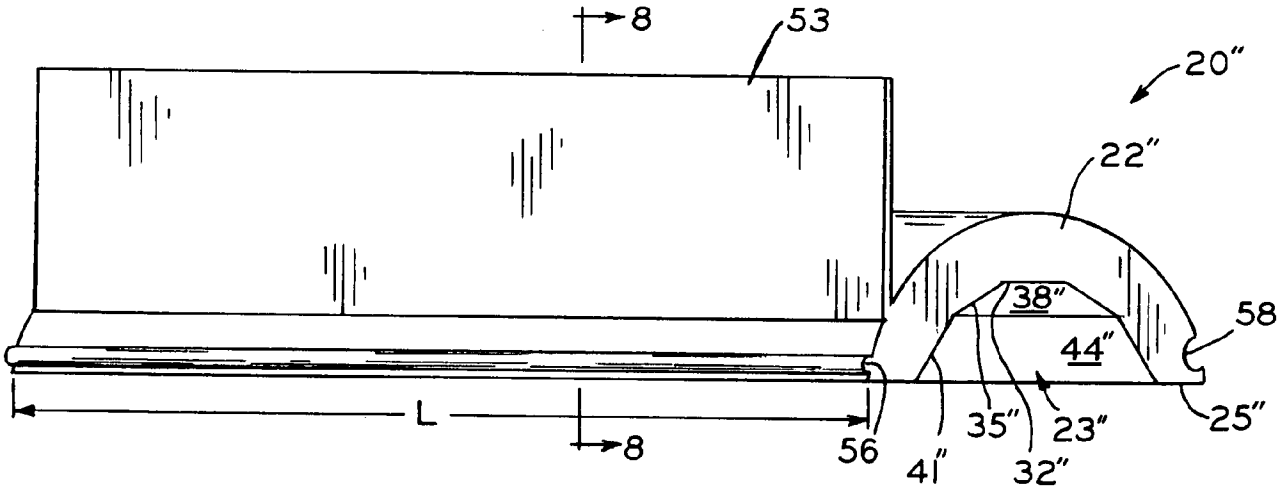
FIG. 9 is a perspective view of an alternative embodiment device according to the present invention.

Referring now to FIGS. 8 and 9, an alternative embodiment device 20" is shown including base 22" having bottom edge 25" and recess 23" with faces 32", 35", 38", 41", and 44". Heat sink 52" is disposed on top 26" of base 22" and, in one embodiment, heat sink 52" is integrally formed with base 22". In one embodiment, base 22" may include projection 56 and recess 58 to facilitate interconnection between adjacent bases 22" wherein projection 56 of one base 22" is shaped to mate with recess 58 of another base 22". All faces 32", 35", 38", 41", and 44" extend along longitudinal length L of base 22". Although not shown, LEDs 50 may be disposed along faces 32", 35", 38", 41", and 44" in a straight line arrangement on each respective face. In one embodiment, light emitted from LED 50 on each respective face converges along a line centered over center or first face 32", similar to device 20', as described above. In one embodiment, each base 22" may have length L which measures approximately 5 inches.

As shown in FIG. 8, angled or second faces 35" and 38" are disposed at first angle $\alpha$ with respect to a plane containing face 32". In one embodiment, first angle $\alpha$ is between 25° and 30°. In an alternative embodiment, first angle $\alpha$ is 26.9902°. As shown in FIG. 8, angled or third faces 41" and 44" are disposed at second angle $\beta$ with respect to a plane containing face 32". In one embodiment, second angle $\beta$ is between 50° and 60°. In an alternative embodiment, second angle $\beta$ is 53.9839°. Various other measurements for angle $\alpha$ and angle $\beta$ may be chosen depending on the distance from device 20" to the substance to be cured. Additionally, the measurements of angle $\alpha$ and angle $\beta$ may vary depending on the dimensions of base 22", for example, if base 22" is widened, the measurements for angle $\alpha$ and angle $\beta$ would necessarily change to sustain the focused area of amplified power supplied by LEDs 50. Thus, angle $\alpha$ and angle $\beta$ could possibly measure anywhere between 0° and 90°.

In an alternative embodiment, more than one device 20" may be employed in an end-to-end manner such as to lengthen the area of amplified power provided by LEDs 50 on device 20" and provide a modularized system. In such an embodiment, more than one power supply may need to be employed for each device 20", or, alternatively, a modified power supply could supply power to every device 20" in the arrangement. If more than one device 20" is employed, an inert atmosphere chamber (not shown) may be employed instead of the curtain-type inert atmosphere generation described above.

In all of the above embodiments, LEDs 50 are driven by a power supply (not shown) which is capable of supplying constant current or adjustable pulsed current. LEDs 50 may be overdriven by the power supply to obtain greater power from LEDs 50. A control card may be employed to control the current supplied to LEDs 50. For example, one control card may control one device 20" (FIGS. 8-9) which may, in one embodiment, include 65 LEDs 50. In another example, one control card may control thirteen strings of five LEDs each.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A device for curing fluid comprising:

a base having a group of contiguous faces forming a recess in the base including a centrally located first planar face and a plurality of second planar faces completely surrounding said first face, each of said plurality of second faces being disposed at an angle with respect to said first face; and a plurality of light-emitting diodes positioned on the group of faces such that at least some of said first and second faces have a light-emitting diode positioned thereon, each of said light-emitting diodes emitting electromagnetic energy at a bandwidth selected to cure said fluid.

2. A device of claim 1 wherein at least some of said first and second faces each include more than one light-emitting diode of said plurality of light-emitting diodes.

3. A device of claim 1 wherein each of said first and second faces includes a light-emitting diode.

4. A device of claim 1 further comprising a printed circuit positioned on said base, said printed circuit connecting each light-emitting diode of said plurality of light-emitting diodes to a power source.

5. A device of claim 1 wherein said first and second faces are oriented in an orientation selected from a group consisting of the following orientations:

each of said second faces comprises a trapezoidal face and said first face comprises a square face; and each of said second faces comprises a rectangular face and said first face comprises a rectangular face.

6. A device of claim 1 wherein said angle comprises an angle in a range from about 35° to about 45°.

7. A device of claim 1 further comprising an inert atmosphere proximate the device.

8. A device of claim 1 wherein said base comprises a thermally conductive polymer.

9. A device of claim 1 wherein said base comprises a combination of a thermally conductive polymer and a metal.

10. A device for curing fluid comprising:

a base having a group of contiguous faces forming a recess in the base including an elongate first planar face and a plurality of elongate second planar faces adjacent said first face, each of said plurality of second faces being disposed at an angle with respect to said first face; and a plurality of light-emitting diodes positioned on the group of faces such that at least some of said first and second faces have a light-emitting diode positioned thereon, each of said light-emitting diodes emitting electromagnetic energy at a bandwidth selected to cure said fluid.

11. A device of claim 10 wherein at least some of said first and second faces each include more than one light-emitting diode of said plurality of light-emitting diodes.

12. A device of claim 10 wherein each of said first and second faces includes a light-emitting diode.

13. A device of claim 10 further comprising a printed circuit positioned on said base portion, said printed circuit connecting each light-emitting diode of said plurality of light-emitting diodes to a power source.

14. A device of claim 10 wherein said first and second faces are oriented in an orientation selected from a group consisting of the following orientations:

each of said second faces comprises a trapezoidal face and said first face comprises a square face;

each of said second faces comprises a trapezoidal face and said first face comprises a rectangular face; and each of said second faces comprises a rectangular face and said first face comprises a rectangular face.

15. A device of claim 10 wherein said angle comprises an angle in a range from about 35° to about 45°.

16. A device of claim 10 wherein said base comprises a thermally conductive polymer.

17. A device of claim 10 wherein said base comprises a combination of a thermally conductive polymer and a metal.

18. A device for curing fluid comprising:

a base having a group of contiguous faces forming a recess in the base including a centrally located first planar face, a plurality of second planar faces adjacent said first face, and a plurality of third planar faces, each of said plurality of second faces being disposed at a first angle with respect to said first face, each of said plurality of third faces being disposed at a second angle with respect to said first face; and a plurality of light-emitting diodes positioned on the group of faces such that at least some of said first, second, and third faces have a light-emitting diode positioned thereon, each of said light-emitting diodes emitting electromagnetic energy at a bandwidth selected to cure said fluid.

19. A device of claim 18 wherein at least some of said first, second, and third faces each include more than one light-emitting diode of said plurality of light-emitting diodes.

20. A device of claim 18 wherein each of said first, second, and third faces includes a light-emitting diode.

21. A device of claim 18 wherein said first, second, and third faces are oriented in an orientation selected from a group consisting of the following orientations:

each of said second faces comprises a rectangular face, each of said third faces comprises a rectangular face, and said first face comprises a rectangular face;

each of said second faces comprises a trapezoidal face, each of said third faces comprises a trapezoidal face, and said first face comprises a rectangular face;

each of said second faces comprises a trapezoidal face, each of said third faces comprises a trapezoidal face, and said first face comprises a square face;

each of said second faces comprises a trapezoidal face, each of said third faces comprises a rectangular face, and said first face comprises a rectangular face;

each of said second faces comprises a trapezoidal face, each of said third faces comprises a rectangular face, and said first face comprises a square face;

each of said second faces comprises a rectangular face, each of said third faces comprises a trapezoidal face, and said first face comprises a square face.

22. A device of claim 18 wherein said first angle comprises an angle in a range from about 25° to about 30°.

23. A device of claim 18 wherein said second angle comprises an angle in a range from about 50° to about 60°.

24. A device of claim 18 wherein said base comprises a thermally conductive polymer.

25. A device of claim 18 wherein said base comprises a combination of a thermally conductive polymer and a metal.

26. A device for curing fluid on a substrate comprising:

a support adapted for holding a substrate having fluid thereon;

a base mounted a preselected distance from the support having a face forming a recess in the base; and a plurality of light-emitting diodes positioned on the face such that light beams emitted by the diodes intersect above the support and overlap, forming a light pattern on fluid on a substrate when the substrate is held on the support, said pattern being selected from a group of patterns comprising:

a spot of light having a width approximately equal to that of the light beams emitted by the diodes; and a line of light having a width approximately equal to that of the light beams emitted by the diodes.

* * * * *